United States Patent [19]

Dickerson

[11] 4,007,683

[45] Feb. 15, 1977

[54] AUXILIARY DRIVE AND SPROCKET ADAPTER FOR INK FOUNTAIN ROLLER

[76] Inventor: Henry R. Dickerson, 741 S. Chase Lane, Lombard, Ill. 60148

[22] Filed: May 11, 1976

[21] Appl. No.: 685,337

[52] U.S. Cl. ..... 101/363

[51] Int. Cl.[2] ..... B41F 31/06

[58] Field of Search ..... 101/349, 350, 351, 352, 101/363, 206, 207, 208

[56] References Cited

UNITED STATES PATENTS

| | | | |
|---|---|---|---|
| 1,785,158 | 12/1930 | Tornberg | 101/350 |
| 1,955,752 | 4/1934 | Lamatsch | 101/349 |
| 2,406,928 | 9/1946 | Taylor et al. | 101/350 |
| 3,098,437 | 7/1963 | Tyma, Jr. et al. | 101/350 |
| 3,170,397 | 2/1965 | Dutro et al. | 101/350 |
| 3,750,568 | 8/1973 | Weisgerber | 101/248 |

*Primary Examiner*—J. Reed Fisher

*Attorney, Agent, or Firm*—Woodhams, Blanchard and Flynn

[57] ABSTRACT

An auxiliary drive system for attachment to the ink fountain roller of an offset lithographic machine for permitting continuous rotation of the ink roller within the fountain when the machine is stopped or inactive. The auxiliary drive system includes an auxiliary motor mounted on the machine and preferably activated only when the machine is stopped. The auxiliary drive motor is drivingly connected to the ink fountain roller by a one-way clutch and clutch roller adapter which permits a slow but continuous rotational drive of the ink fountain roller when the machine is stopped, and which freely overruns to permit rotation of the ink fountain roller when the machine is activated.

1 Claim, 6 Drawing Figures

AUXILIARY DRIVE AND SPROCKET ADAPTER FOR INK FOUNTAIN ROLLER

FIELD OF THE INVENTION

This invention relates to an auxiliary drive system for attachment to the ink fountain roller of a lithographic machine to permit continuous rotation of the ink fountain roller during periods when the machine is stopped or shut down.

BACKGROUND OF THE INVENTION

Known lithographing machines utilize an ink fountain arrangement wherein the ink fountain roller is disposed within an ink fountain and continously rotates during operation of the machine. However, in these known machines, a shutdown of the machine also results in stoppage of the ink fountain roller, whereupon the ink on the fountain roller dries so that washing and cleaning of the fountain and of the roller is often necessary prior to further activation of the machine. This problem of machine shutdown occurs due to numerous reasons, such as due to the machine being stopped over night, stoppage of the machine during make ready periods, stoppage of the press for lunch hours and the like. Due to the numerous reasons why machines are stopped, the drying of ink on the ink fountain roller is thus a formidable problem and requires substantial time and maintenance in readying the roller for further machine operation.

Accordingly, it is an object of the present invention to overcome the above-mentioned disadvantages by providing an auxiliary drive system for attachment to the ink fountain roller of a lithographic machine, which auxiliary drive system permits the continuous rotation of the ink roller within the fountain throughout the shutdown periods of the machine so as to prevent the ink from drying on the ink fountain roller and thereby eliminating the necessity of having to clean the roller each time the machine is started up, thus saving substantial time in making the machine ready for operation.

It is also an object of the present invention to provide an auxiliary drive system, as aforesaid, which can be readily adapted to existing lithographic machines without requiring any major rebuilding or shutdown of the machine.

A further object of the present invention is to provide an auxiliary drive system, as aforesaid, which utilizes an auxiliary drive motor mounted on the machine and interconnected to the ink fountain roller by a one-way clutch and adapter which permits slow but continuous rotation of the ink roller during periods of machine shutdown, but which permits free rotation of the ink roller during periods of machine operation.

Still a further object of the present invention is to provide an auxiliary drive system, as aforesaid, which is economical to manufacture and install on the machine, which is extremely simple in operation, which is both reliable and durable, and which does not interfere with the normal machine structure.

Other objects and purposes of the present invention will be apparent to persons acquainted with machines of this general type upon reading the following specification and inspecting the accompanying drawings.

Figure 5:
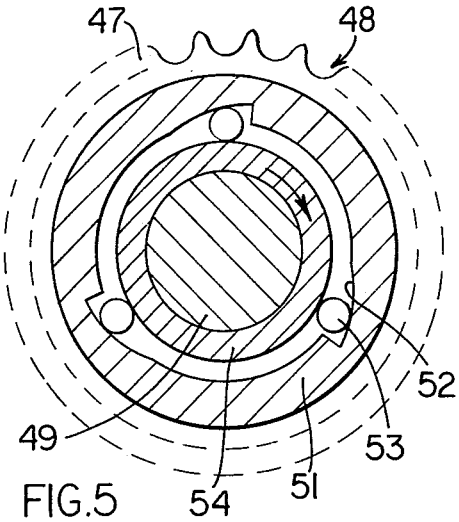
FIG. 5 is a sectional view of the one-way clutch and adapter as taken substantially along the line V—V in FIG. 4.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the device and designated parts thereof. Said terminology will include the words above specifically mentioned, derivatives thereof and words of similar import.

SUMMARY OF THE INVENTION

The objects and purposes of the present invention, including those set forth above, are met by providing a conventional lithographic machine having an ink fountain and a rotatable ink roller associated therewith. According to the present invention, an auxiliary drive mechanism is mounted on the machine and is drivingly connected to the ink roller to continuously rotate same during periods when the machine is shut down. The auxiliary drive system includes an auxiliary motor mounted on the machine and drivingly connected to the ink roller by an intermediate clutch and adapter which permits driving of the ink roller when the machine is stopped. The auxiliary drive motor is preferably automatically energized only during those periods when the machine is shut down.

DETAILED DESCRIPTION

Figure 1:
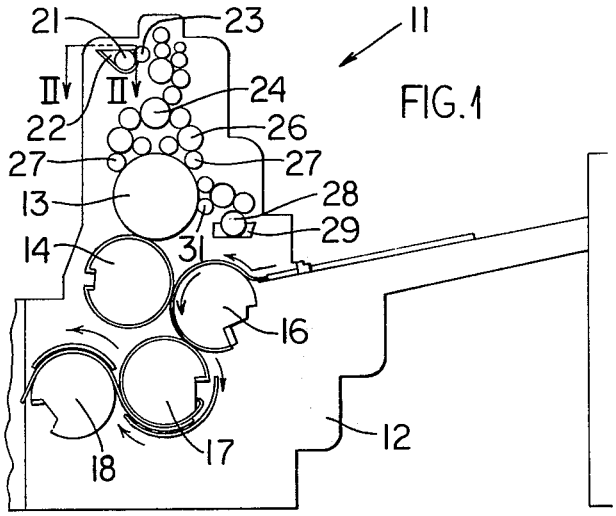
FIG. 1 is an end elevational view of a conventional offset lithographic machine.

FIG. 1 diagrammatically illustrates a conventional offset lithographic machine 11, which machine includes a housing or frame 12 having numerous rollers rotatably supported thereon. The machine includes a rotatable plate cylinder 13 adapted to have a lithographic plate fixedly secured therearound. The image to be printed is transferred from plate cylinder 13 to a blanket cylinder 14 having a blanket therearound, which blanket may be of rubber and coacts with an impression cylinder 16. The stock to be printed moves, as indicated by arrows in FIG. 1, between the cylinders 14 and 16 so as to be printed, and then passes around a plurality of further rollers 17 and 18, from which the printed stock is then delivered either to a further press or discharged into a delivery pile.

The machine 11 also has an ink roller 21 disposed in a conventional manner for association with an ink fountain 22. The ink from the ink roller 21 is transferred via intermediate transfer roller 23 to a distributing roller 24, from which the ink is then transferred through intermediate rollers 26 to the form rollers 27 which engage the lithographic plate fixed on the plate cylinder 13.

As is conventional, machine 11 also has a moisture roller 28 associated with a moisture or water fountain 29, from which the moisture is transmitted to form rollers 31 which are disposed in engagement with the lithographic plate mounted on the plate cylinder 13.

Figure 2:
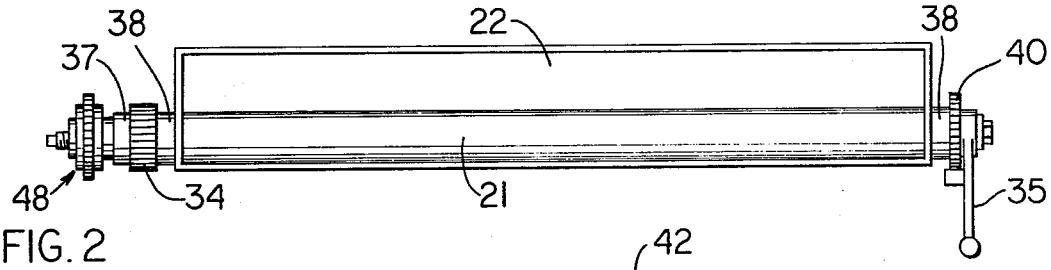
FIG. 2 is an enlarged view, partially in cross section, taken substantially along the line II—II in FIG. 1 and illustrating the ink fountain and its associated roller.
Figure 6:
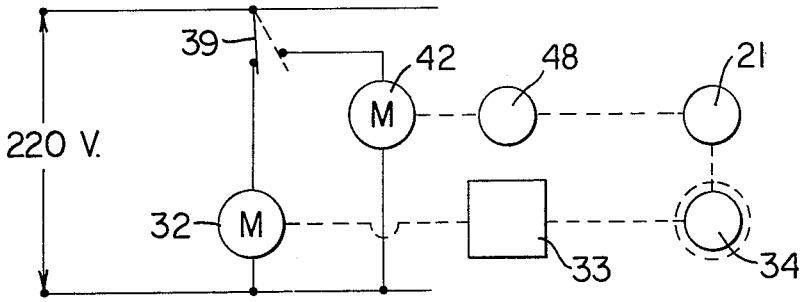
FIG. 6 diagrammatically illustrates a portion of the electrical control system for the machine.

The press rollers are driven indirectly from a main drive motor 32 which, as schematically illustrated in FIG. 6, is connected via a conventional power transmitting device 33, such as a gear train, which in turn is connected to a mechanical clutch associated with the fountain roller. The driving of the ink fountain roller 21 by the main drive motor 32 occurs through the intermediate gear train 33 which is connected to a driven gear 34 (FIG. 2), which gear 34 is rotatably supported on a shaft extension 36 fixed to and projecting outwardly from one end of the ink roller 21. Gear 34 is drivingly connected to shaft extension 36 by means of a conventional one-way clutch 37. A similar shaft extension is fixed to and projects outwardly from the other end of the ink roller 21, with the shaft extensions being rotatably supported by bearings 38.

The conventional machine 11 also has a ratchet crank 35 supported on the ink roller shaft extension, which crank 35 is drivingly connected to the shaft extension by a standard one-way ratchet drive 40. This ratchet assembly 35,40, is provided to permit intermittent manual rotation of the ink roller 21 during periods when the machine is shut down.

The energization of the main drive motor 32 and the resulting rotation of the machine rollers, including the ink roller 21, is controlled by a main control switch 39 which is illustrated in FIG. 6 as being in its "on" position.

The machine structure as described is conventional and thus further description of this structure is not believed necessary.

As noted above, one of the problems encountered with known machines is the problem of ink drying on the ink fountain roller when the machine is shut down, which shutdown results in stoppage of the ink fountain roller. This stoppage of the ink fountain roller has permitted the ink to dry on the roller and has required substantial cleanup of the roller prior to the initiation of further machine operations. Accordingly, to overcome this problem, the present invention provides an auxiliary drive system 41 disposed for coaction with the ink fountain roller 21 to permit continuous rotation of the roller 21 during periods when the machine is stopped or shut down.

Figure 3:
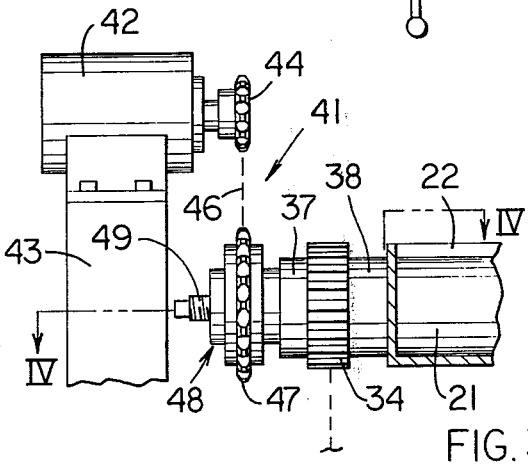
FIG. 3 is a fragmentary elevational view of the press and illustrating the auxiliary drive system of the present invention and its attachment to one end of the ink fountain roller.

The auxiliary drive system 41, as illustrated in FIG. 3, includes an auxiliary drive motor 42 (preferably an electric motor) fixedly mounted on the upper end of a side pedestal 43 which comprises a portion of the main frame or housing 12. The auxiliary drive motor 42 is connected to the ink fountain roller 21 by means of an intermediate power transmitting device, which, in the illustrated embodiment, includes a drive sprocket 44 which is fixedly secured to the motor shaft and is disposed in driving engagement with an endless chain 46. The chain 46 in turn is engaged with a driven sprocket 47 which is substantially coaxially aligned with the ink roller 21. The driven sprocket 47 is drivingly interconnected to a special hub adapter 49 by means of an intermediate clutch 48, which clutch is preferably a one-way or over-running clutch. The hub adapter 49 is in turn fixedly connected to the end of the shaft extension 36 as associated with the ink fountain roller 21.

Figure 4:
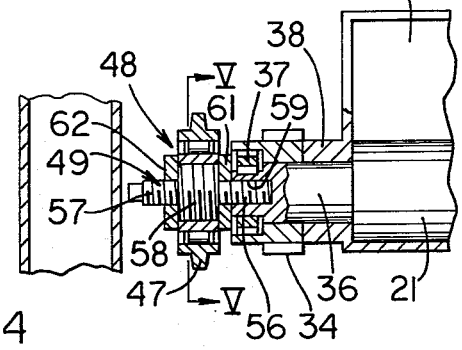
FIG. 4 is a fragmentary sectional view taken substantially along the line IV—IV in FIG. 3.

The clutch 48, in a preferred embodiment of the invention, comprises a one-way or overrunning clutch, and one possible form of clutch is illustrated in FIGS. 4 and 5. The one-way clutch includes an outer hub portion 51, which, in the illustrated embodiment, is fixed to and integral with the driven sprocket 47. The outer hub portion has a plurality of elongated cam slots 52 formed in the inner periphery thereof and spaced circumferentially therearound, and an intermediate driving roller 53 is associated with each slot 52. The rollers 53 are disposed for engagement with the outer periphery of an inner annular hub 54 which, in the illustrated embodiment, is fixedly secured to the threaded adapter 49.

FIG. 5 illustrates the clutch in its disengaged position, whereupon the ink roller 21 and the adaper shaft 49 connected thereto can freely rotate in the direction as indicated by the arrow, whereupon the driven sprocket 47 is permitted to remain stationary. However, when the clutch is moved into an engaged position, such as when the driven sprocket 47 is rotated (clockwise in FIG. 5), then the rollers 53 are moved to the opposite ends of the slots 52, which slots are narrower at the opposite ends so that the rollers 53 thus wedgingly engage the hubs 51 and 54 together so that the inner hub 54 is driven from the outer hub 51. The structure and operation of the one-way clutch, as described above, is conventional and further description of same is not believed necessary.

The threaded hub adapter 49 is formed integrally in one piece and, as shown in FIG. 4, includes a pair of coaxially aligned threaded shaft portions 56 and 57 projecting axially outwardly from opposite ends of a central threaded hub portion 58. The central hub portion 58 is of substantially larger diameter than the shaft portions 56 and 57, which portions are of approximately the same diameter. The central hub portion 58 is threadably engaged with the inner clutch hub 54, whereas the threaded shaft portion 56 is threadably engaged within a threaded opening 59 which is formed coaxially within one end of the shaft extension 36. A spacer 61 is positioned between the hub portion 58 and the adjacent end of the shaft extension 36, and a threaded nut 62 is mounted on the other shaft portion 57 for securing the inner clutch hub 54 on the adapter.

The integral one-piece adapter 49 can be easily attached to an existing machine by providing a suitable threaded opening 59 in the free end of the shaft extension 36, thereby facilitating both the attachment or removal of the hub adapter from the fountain roller. The complete auxiliary drive mechanism can thus be easily attached to or removed from either a new machine or an existing machine, while at the same time the auxiliary drive mechanism is completely independent of the main driving system associated with the machine.

OPERATION

The operation of the present invention, as incorporated on a lithographic machine, will be briefly described to ensure a complete understanding thereof.

During conventional operation of the machine 11, the main control switch 39 is normally in its "on" position (as illustrated by solid lines in FIG. 6) so that the main drive motor 32 is energized and causes rotation of the ink roller 21 via the gear train 33 and clutch 37.

During operation, the clutch 48 is normally maintained in a disengaged position as illustrated in FIG. 5 whereby the ink roller 21 is permitted to freely rotate. When the machine 11 is to be stopped, then the main control switch 39 is moved into its "off" position, as shown by dotted lines in FIG. 6, which results in de-energization of main drive motor 32 and causes stoppage of the machine. In conventional machines, this stoppage also results in stoppage of the ink roller 21.

However, in the present invention, movement of the main control switch 39 into its "off" position results in energization of the auxiliary drive motor 42 so that the sprocket 44 and chain 46 are driven, thereby resulting in driving of the driven sprocket 47. The driving of sprocket 47 causes the clutch rollers 53 to be moved into the other ends of the slots 52 so that the clutch 48 becomes engaged and the inner hub 54 is thus rotatably driven by the sprocket 47. This in turn results in rotation of the ink roller 21. Thus, the inner roller is continuously rotated, preferably at a relatively slow rate such as approximately two revolutions per minute, throughout the complete period when the machine is stopped. This prevents the ink from drying on the roller 21.

While the invention preferably energizes the auxiliary drive motor 42 only during periods when the machine is stopped, nevertheless it will be recognized that the auxiliary drive motor 42 can be continuously energized so long as a one-way clutch is utilized for connecting the auxiliary drive motor 42 to the ink roller 21. Under these conditions, when the machine is activated, the higher rotational speed of the ink roller 21 results in the ink roller overrunning the drive sprocket 47 so that the clutch is maintained in its overrunning or disengaged position. However, the one-way clutch 48 will be automatically moved into its engaged position as soon as the main drive of the machine is de-energized, since the de-energization of the main drive 32 results in stoppage of the ink roller 21 so that the overrunning of the ink roller is eliminated and the drive sprocket 47 again functions as a driving member and causes the one-way clutch to be shifted into its engaged position.

Since the auxiliary drive system is totally independent of the main machine drive, the auxiliary drive system can be attached to an existing lithographic machine without effecting the machine drive in any way. Further, the auxiliary drive system as illustrated requires that only the special threaded adapter 49 and sprocket 47 be attached to the end of the ink roller shaft extension so that the auxiliary drive system can likewise be readily attached to a conventional ink roller without requiring any major modification or rebuilding of the ink roller.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an offset lithographic machine having an ink fountain, an ink roller rotatably disposed for association with said fountain, a main drive motor, drive transmitting means connected between said main drive motor and said ink roller for causing rotation of said roller during operation of said machine, said drive transmitting means including a drive gear element rotatably supported on said roller and a one-way clutch device drivingly connected between said driven gear element and said roller, and auxiliary drive means drivingly connected to said ink roller for causing continuous rotation thereof whenever said lithographic machine is shut down, said auxiliary drive means including an auxiliary drive motor and power transmitting means drivingly connected between said auxiliary drive motor and said ink roller for rotating same, said power transmitting means having disengageable one-way clutch means associated therewith and positionable in an engaged position for drivingly rotating said ink roller when the machine is stopped, comprising the improvement wherein said auxiliary drive means is separate and totally independent of said drive transmitting means, said auxiliary drive means including adapter means for mounting said one-way clutch means on the end of said roller so that said clutch means is separate from and totally independent of said clutch device, said adapter means including a one-piece connector shaft fixedly but removably connected to the end of said roller, said connector shaft being coaxially aligned with said roller and including a threaded shaft portion which is threadably received within an opening formed in the end of said roller for fixedly but removably mounting said connector shaft to said roller, said connector shaft also including a hub portion extending outwardy from the end of said roller, said hub portion being spaced axially from said shaft portion and being of larger diameter, said one-way clutch means being concentric with and mounted on said hub portion, said one-way clutch means including an annular driven member fixed to and surrounding said hub portion and an annular driving member concentric to and surrounding said driven member, said clutch means also including overrunning clutch element means disposed between and coacting with said driving and driven member for transmitting torque from said driving member to said driven member, and said power transmitting means including an endless flexible drive element connected between said annular driving member and said auxiliary drive motor, whereby said auxiliary drive means including said connector shaft and said one-way clutch means can be attached to the ink roller of an existing lithographic machine.

* * * * *